United States Patent [19]

Sartor

[11] Patent Number: 4,802,291

[45] Date of Patent: Feb. 7, 1989

[54] SKI BOOT INCORPORATING A FOOT SECURING DEVICE

[75] Inventor: Mariano Sartor, Montebelluna, Italy

[73] Assignee: Nordica S.P.A., Montebelluna, Italy

[21] Appl. No.: 75,717

[22] Filed: Jul. 20, 1987

[30] Foreign Application Priority Data

Jul. 25, 1986 [IT] Italy ..... 82560 A/86

[51] Int. Cl.[4] ..... A43B 5/04

[52] U.S. Cl. ..... 36/119; 36/58.5

[58] Field of Search ..... 36/117–121, 36/50, 54, 58.5, 105, 88, 93

[56] References Cited

U.S. PATENT DOCUMENTS

| | | | |
|---|---|---|---|
| 4,196,530 | 4/1980 | Delery | 36/119 |
| 4,253,251 | 3/1981 | Salomon | 36/119 |
| 4,620,379 | 11/1986 | Sartor | 36/119 |
| 4,654,985 | 4/1987 | Chalmers | 36/117 X |
| 4,698,922 | 10/1987 | Sartor | 36/119 |

FOREIGN PATENT DOCUMENTS

| | | | |
|---|---|---|---|
| 0132744 | 2/1985 | European Pat. Off. | 36/119 |

*Primary Examiner*—James Kee Chi

*Attorney, Agent, or Firm*—Guido Modiano; Albert Josif

[57] ABSTRACT

The foot securing device comprises, inside the shell, a single traction element such as a cable. This cable has a first portion which embraces a pressor in the metatarsal region and is inclined with respect to the longitudinal axis of the shell. Conveniently, the firt portion of the cable extends from the inner part of the foot adjacent to the big toe towards the outer part thereof in the direction of the instep. The cable furthermore has a second portion extending rearwardly with respect to the boot, which affects the region of the heel of the foot, and/or with a third portion extending transversely above said presser in the foot instep region. Advantageously, a spool for tensioning the cable is associated therewith.

10 Claims, 3 Drawing Sheets

SKI BOOT INCORPORATING A FOOT SECURING DEVICE

BACKGROUND OF THE INVENTION

The present invention relates to a foot securing device, particularly for ski boots.

Devices are currently known which separately or simultaneously provide securings of the instep, of the heel and of the metatarsal region.

In particular, the securing of the metatarsal region occurs by means of traction elements such as, for example, cables or bands which cross the foot transversely.

Such an arrangement of the cable creates a distribution of pressure which affects a limited region of the foot, that is to say, only the transverse section of the metatarsal region.

The disadvantage found in such known types of ski boots resides in the fact that such a localization creates an uncomfortable feeling of "cutting" on the user's foot at the metatarsal and/or tarsal region.

SUMMARY OF THE INVENTION

The aim of the present invention is therefore to eliminate the disadvantages described above in known types, by providing a device which allows the securing of one or more regions of the foot inside a ski boot, optimizing, in particular, the distribution of the pressures at the metatarsal region.

Within the scope of the above described aim, a further important object is to provide a foot securing device which allows the self-adjustment of the tension of a possible traction element at the various affected regions of the foot.

Another important object is to provide a securing device which is structurally simple and simplified in actuation.

Not least object of the present invention is to provide a device which can be easily obtained starting from elements and materials commonly available on the market, and which is furthermore competitive from a merely economical point of view.

The aim and the objects described above, as well as others which will become apparent hereinafter, are achieved by a foot securing device, particularly for ski boots comprising a single traction element inside the shell, characterized in that said traction element has a first portion which embraces a presser in the metatarsal region and is arranged inclined with respect to the longitudinal axis of the shell, and/or a second portion extending rearwardly with respect to the boot and affecting the region of the heel, and/or a third portion extending transversely above said presser in the foot instep region.

Advantageously, said first portion of said traction element extends from the inner part of the foot adjacent to the big toe towards the outer part thereof in the direction of the instep.

Advantageously, tensioning means for said traction element are associated therewith.

BRIEF DESCRIPTION OF THE DRAWINGS

Further characteristics and advantages of the invention will become apparent from the description of a particular, but not exclusive, embodiment, illustrated only by way of non-limitative example in the accompanying drawings, wherein.

DESCRIPTION OF THE PREFERRED EMBODIMENTS

Figure 2:
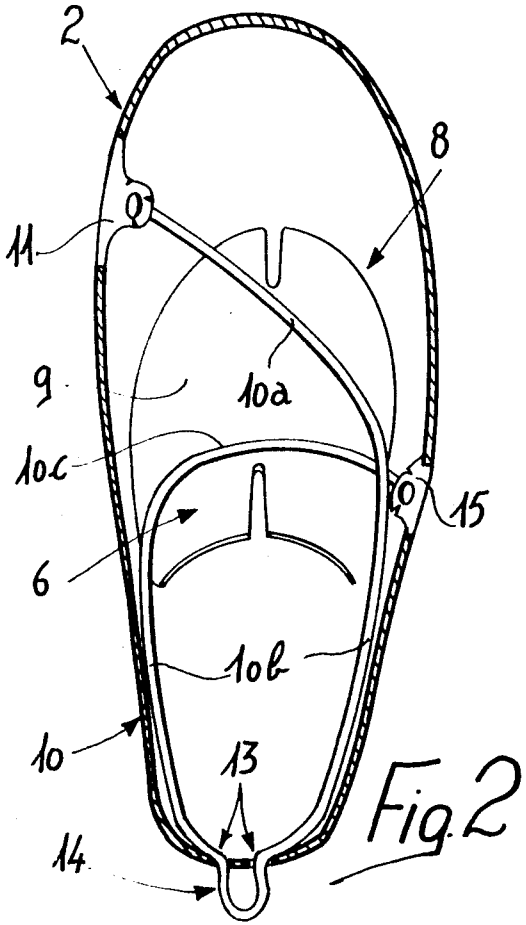
FIG. 2 is a top plan view of the arrangement of the traction element.
Figure 3:
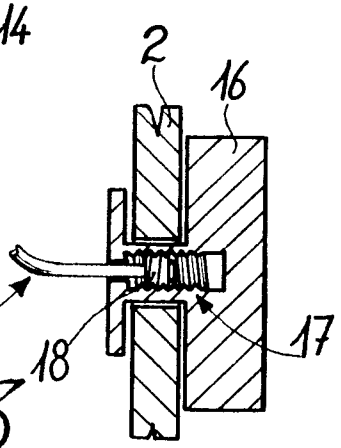
FIG. 3 is a view of a means for the tensioning of said traction element.
Figure 1:
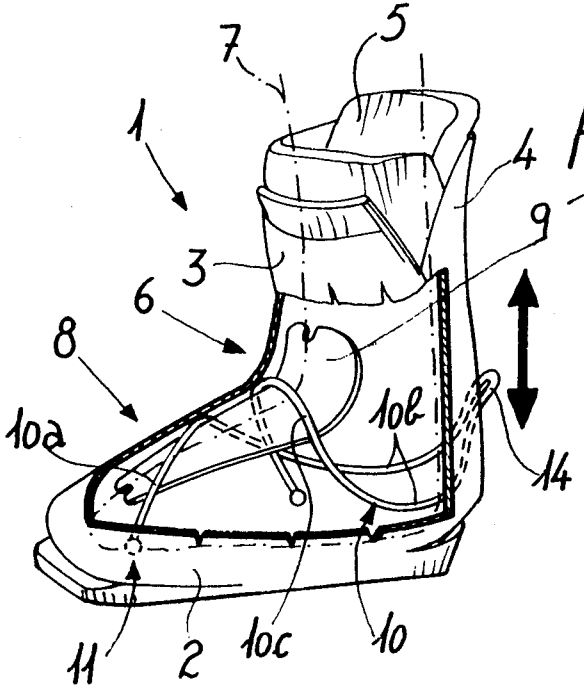
FIG. 1 is a partially cross sectional lateral elevational view of a ski boot incorporating a foot securing device according to the invention.

With reference to the figures described above, the reference numeral 1 indicates a ski boot, essentially consisting of a shell 2 whereto are hinged, in a per se known manner, a front quarter 3 and a rear quarter 4.

An inner shoe 5 is provided inside the boot 1, and a presser 9 is interposed between said inner shoe and the shell 2, at the foot instep region 6 and at the metatarsal region 8, the foot being schematically indicated by the dotted line 7.

Said presser contributes, together with a traction element composed of a cable 10 and arranged inside the boot 1, to constitute the foot securing device.

The cable 10 is provided with one end rigidly associated with the shell 2 at its lateral surface 11 embracing the inner part of the foot in a region adjacent to the big toe.

The cable 10 then defines a first portion 10*a* which, starting from the region adjacent to the big toe, embraces the presser 9 at the region 8 of the foot in the direction of the outer malleolus, thus arranging itself inclined with respect to the longitudinal axis of the shell 2.

After the first portion 10*a*, the cable 10 has a second portion 10*b* which extends affecting the rear portion of the boot, said second portion 10*b* being followed by a third portion 10*c*.

At the heel region, said cable 10, however, projects out of the shell and re-enters the same through adapted holes 13, to define a half eyelet 14 to be gripped by a traction device consisting for example of a lever or of any other mechanism capable of exerting the required traction on said cable 10.

The third portion 10*c* of the latter extends transversely above the presser 9 at the region 6 of the foot instep, the terminal end of said portion being rigidly associated with the shell 2 at the lateral surface 15 adjacent to the outer part of the foot proximate to the region 6.

Advantageously, a means for the fine tensioning of said cable 10 is associable with one of the ends thereof, and consists of a spool 16, rotatably associated with the shell 2, which is provided with an inwardly threaded axial seat 17 which cooperates with a complementary threaded bush 18 rigidly associated with the terminal end of said cable 10.

The use of the device is extremely simple; in fact, by providing the traction of the half eyelet 14, a securing action is exterted simultaneously on the metatarsal region and on the foot instep.

In the first case, furthermore, the arrangement of the portion 10*a* allows to achieve an optimum distribution of pressures on the metatarsal and tarsal region, increasing the characteristics of comfort of the boot.

It should be furthermore observed that the use of a single cable allows the self-adjustment of its tension at the regions more highly stressed, according to the specific conditions of use.

It has been observed that the invention achieves the aim and the objects intended, a device having been provided with allows to obtain a perfect securing action with an optimum distribution of pressures, especially at the metatarsal region.

Moreover, the presence of a single cable allows the same to be arranged in an optimum manner on the affected regions, ensuring the homogeneity of the securing action.

Naturally, the invention is susceptible to numerous modifications and variations, all of which are within the scope of the same inventive concept.

Figure 5:
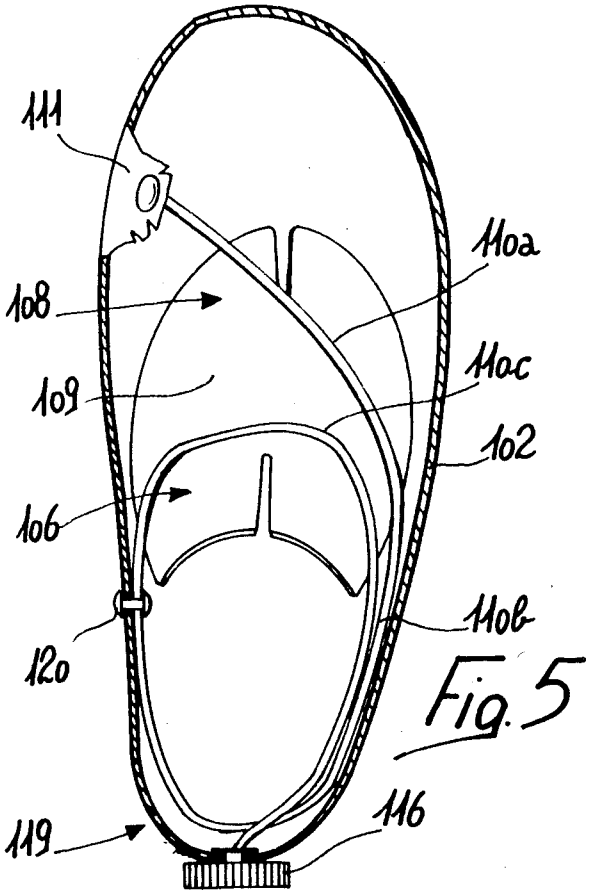
FIGS. 4 and 5 are views of another embodiment of the arrangement of the traction element.
Figure 4:
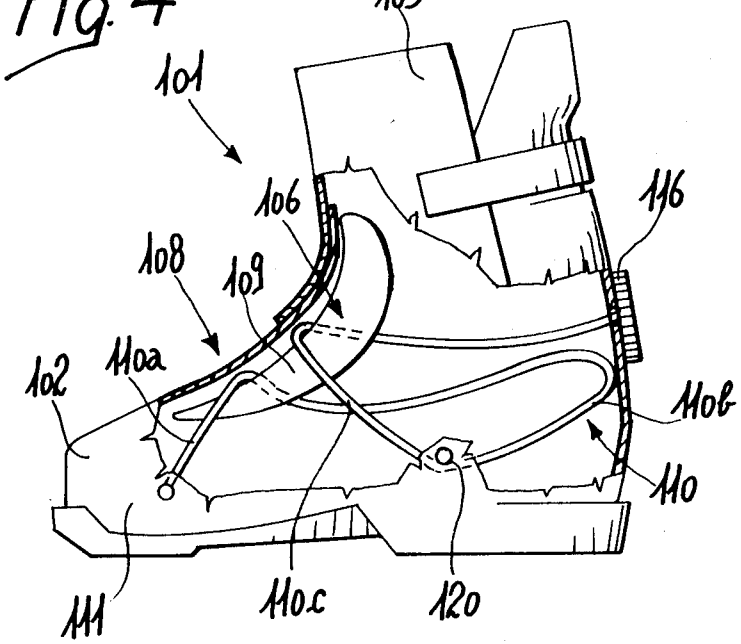

Thus, for example, FIGS. 4 and 5 illustrate another embodiment wherein, inside the boot 101, a traction element is provided, consisting of a cable 110 having a first portion 110*a* the end whereof is associated with the shell at the lateral surface 111 which embraces the inner part of the foot in a region adjacent to the big toe.

The portion 110*a* then embraces the presser 109 at the metatarsal region 108 in the direction of the outer malleolus, thus arranging itself inclined with respect to the longitudinal axis of the shell 102.

The cable 110 then defines a second portion 110*b* which rearwardly embraces the boot at the heel region 119 whereat, a suitable presser is arrangeable.

At said second portion 110*b*, a return element 20 is provided which can consist, for example, of the lateral pivoting element of the front quarter 103 of the shell 102.

The portion 110*b* is followed by a third portion 110*c* which extends transversely above the presser 9 at the foot instep region 106, said third portion 110*c* extending laterally at the outer malleolar region of the foot until it returns to the region 119 of the heel wherein its end is associated with an adapted means for its tensioning, consisting of a spool 116 or of any other mechanism capable of performing the required traction on said cable 110.

Figure 6:
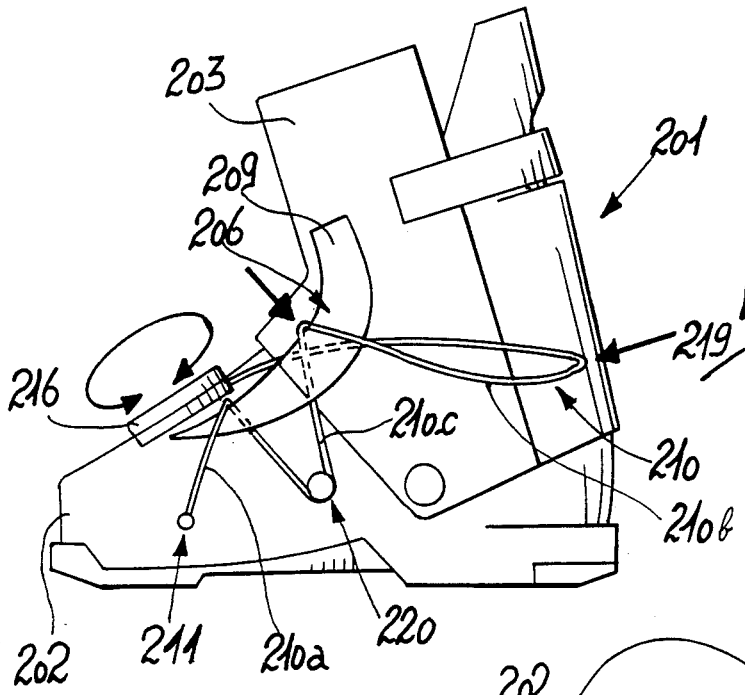
FIGS. 6 and 7 are views of a further embodiment related to the path of said traction element.
Figure 7:
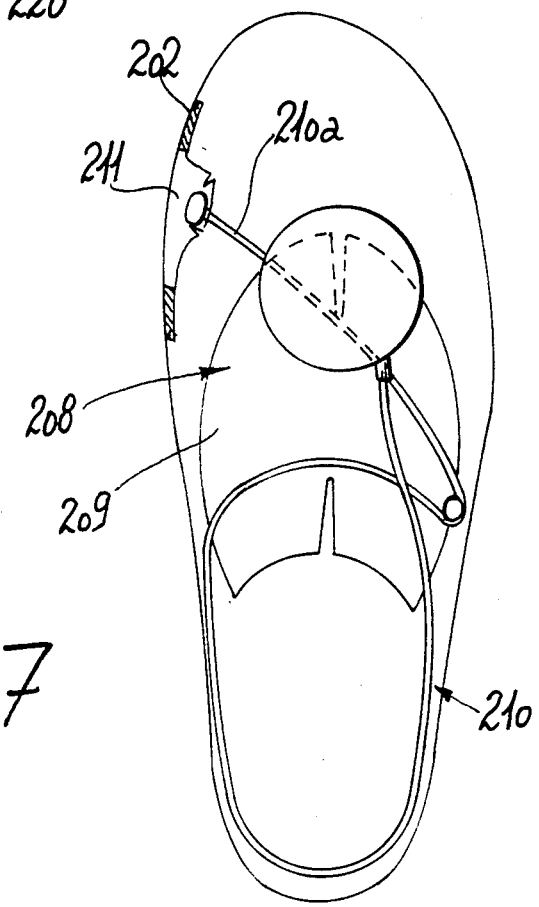

FIGS. 6 and 7 illustrate, in a second embodiment, a right boot 201 provided with a foot securing device comprising a cable 210 which is provided with a first portion 210*a* the end whereof is rigidly associated with the lateral surface 211 of the shell 202 embracing the inner part of the foot in a region adjacent to the big toe.

Said portion 210*a* then embraces the presser 209 at the metatarsal region 208 in the direction of the outer malleolus, said portion 210*a* then being arranged inclined with respect to the longitudinal axis of the shell 202.

The cable 210 then cooperates with a return element 220, consisting for example of the pivoting element of the front quarter 203 to the shell 202.

The cable 210, following the portion 210*a*, further has a portion 210*c* which extends transversely and above said presser 209 at the foot instep region 206 towards the inner malleolus.

The portion 210*c* is followed by a further portion 210*b* which extends rearwardly with respect to the boot at the heel region 219, its terminal end being returned to the metatarsal region 208 and then connected to a means for tensioning, consisting, for example, of a spool 216 which winds said cable or, in any case, of any other mechanism capable of exerting the desired traction.

These embodiments also allow to achieve the aim and the objects intended, said foot securing device being furthermore particularly simple and economical.

Naturally, all the components of the securing device can be provided with the shapes and dimensions which are most adapted to the specific requirements, the materials which compose the same being similarly any according to the requirements.

I claim:

1. In a ski boot incorporating a foot securing device, said ski boot comprising an upper, a substantially elongated shell having a toe portion, a heel portion, an instep portion and a metatarsal portion, a foot presser mounted internally of said shell so as to face said intep and metatarsal portions thereof, a single traction element mounted internally of said shell for acting on said presser at least partially, said traction element including a first overlapping said presser adjacent said metatarsal portion of said shell, a second tract extending internally of said shell between said metatarsal and said heel portion thereof, and a third tract overlapping said presser adjacent said instep portion of said shell, the improvement consisting of the fact that said first tract of said traction element extends obliquely with respect to the longitudinal direction of said shell from one side to the other thereof to thereby embrace said presser both transversely and longitudinally thereof.

2. A ski boot according to claim 10, wherein said first tract of said traction element has a free end which is rigidly connected to said shell laterally thereof in a location proximate the inner part of the user's toe, there being further provided means for guiding the other end of said first tract which confines with said second tract internally of said shell towards the external malleolus of a user's foot.

3. A ski boot according to claim 1, wherein said shall comprises in the heel portion thereof a pair of holes for the inlet and the outlet of one at least partially looped portion of said second tract of said traction element, said at least partially looped portion defining a half eyelet for the passage of a manually operable means for the tensioning of said traction element.

4. A ski boot according to claim 1, wherein said third tract of said traction element extends over said presser substantially perpendicularly of the longitudinal direction of said shell and has a free end which is rigidly connected to said shell proximate said instep portion thereof and on the external side thereof.

5. A ski boot according to claim 1, wherein said traction element comprises a substantially flexible cable.

6. A ski boot according to claim 5, wherein said traction element further includes means for tensioning said cable.

7. A ski boot according to claim 1, wherein said means for tensioning said cable comprises a spool rotatably mounted on said shell and provided with an internally threaded seat, an externally threaded bush being associated with one end of said cable for cooperation with said internally threaded seat of said spool, whereby on rotation of said spool said bush is caused to displace longitudinally of said seat to thereby provide tensioning of said cable.

8. A ski boot according to claim 3, further comprising guiding means for inverting the direction of said traction element and acting on said second tract thereof.

9. A ski boot according to claim 8, wherein said said guiding means includes one lateral pivoting pin for the articulation of said upper on said shell arranged on the internal side of a user's foot such as to guide said second tract of said traction element towards said heel portion of said shell, said third tract of said traction element extending forwardly over said presser transversely thereof and further extending rearwardly of said shell proximate the external malleolar portion of a user's foot, the free end of said third tract being associated with said means for tensioning said traction element which are mounted on said shell adjacent said hell portion thereof.

10. A ski boot according to claim 8, wherein said guiding means is a lateral pivoting pin for the articulation of said upper on said shell arranged on the external side of a user's foot such as to guide said second tract towards said heel portion of said shell, said third tract of said traction element extending forwardly over said presser transversely thereof and further extending rearwardly of said shell proximate the internal malleolar portion of a user's foot, the free end of said third tract being associated with said means for tensioning said traction element which are mounted on said shell adjacent said metatarsal portion thereof.

* * * * *